US005952784A

United States Patent [19]

Witting

[11] Patent Number: 5,952,784

[45] Date of Patent: Sep. 14, 1999

[54] ELECTRODELESS HIGH INTENSITY DISCHARGE LAMPS

[75] Inventor: Harald Ludwig Witting, Burnt Hills, N.Y.

[73] Assignee: General Electric Company, Schenectady, N.Y.

[21] Appl. No.: 09/143,064

[22] Filed: Aug. 28, 1998

[51] Int. Cl.[6] ..... H01J 17/16

[52] U.S. Cl. ..... 313/634; 313/493; 313/607; 313/44; 313/46; 313/635; 313/489; 315/248

[58] Field of Search ..... 313/634, 635, 313/493, 607, 44, 46, 47, 489; 315/248, 344

[56] References Cited

U.S. PATENT DOCUMENTS 4,810,938 3/1989 Johnson et al. .
5,032,757 7/1991 Witting .
5,032,762 7/1991 Spacil et al. .
5,042,139 8/1991 Farrall .
5,098,326 3/1992 Gorczyca et al. .
5,136,214 8/1992 Roberts et al. .
5,270,615 12/1993 Chang .
5,343,118 8/1994 Chang .
5,373,216 12/1994 Dakin et al. ..... 315/248

*Primary Examiner*—Nimeshkumar D. Patel
*Attorney, Agent, or Firm*—Jill M. Breedlove; Douglas E. Stoner

[57] ABSTRACT

An electrodeless high intensity discharge lamp includes a light-transmissive arc tube for containing a plasma arc discharge, the arc tube having a top and a bottom and a side wall with a fill disposed therein. The fill includes at least one metal halide and a buffer gas. The arc tube has a wall with an interior surface having an annular region around the central extent of the side wall. The interior surface of the arc tube wall is smooth over the majority of its extent but has a liquid-stabilizing roughened surface in the annular region.

10 Claims, 1 Drawing Sheet

ELECTRODELESS HIGH INTENSITY DISCHARGE LAMPS

BACKGROUND OF THE INVENTION

1. Field of the Invention

The present invention relates to an electrodeless high intensity discharge lamp and more particularly pertains to protecting arc tubes by locating a film of excess liquid metal halide in those areas of the arc tube that are most subject to arc erosion, the stabilization being achieved by a mechanically rough surface or a layer of metal oxide powder.

2. Description of the Prior Art

High-pressure, electrodeless, inductively driven gas discharge lamps offer attractive combinations of high efficacy and good color rendition. In order to be economically competitive, such lamps must operate for many thousands of hours without substantial degradation of light output. A major problem with achieving long lamp life is the erosion of those areas of the arc tube that are close to the intense discharge.

In particular, erosion has been observed during life tests conducted upon inductively driven, electrodeless gas discharge lamps. The tested lamps use quartz arc tubes of cylindrical shape with rounded corners. The temperature of the arc tubes ranges from 850 C to 1000 C. The arc tubes are dosed with an inert buffer gas and metal halides, such as sodium iodide and cerium iodide creating a fill or "dose". The metal halide pressure in an operating arc tube is controlled by the temperature of a liquid reservoir of excess metal halide. This reservoir forms at the coolest portions of the inside surface of the arc tube.

It has been observed that after prolonged operation, a damage zone appears on the inside surface of the arc tube. This damage zone is in the form of a ring or annular region that is located along the periphery of the cylindrical arc tube. This is also the region where the intense arc is pressed against the tube surface by the induced radio frequency (RF) field.

The exact mechanisms that lead to the arc tube damage have not yet been fully clarified. It is believed that under the intense ion bombardment and radiation from the arc, chemical reactions occur that lead to arc tube degradation. For instance, sodium iodide is dissociated by the arc into positive sodium ions and negative iodine ions. The positive sodium ions are driven towards the wall by the electric field of the arc. If even a small fraction of these ions do not recombine with iodine before reaching the wall, then the sodium can attack the quartz wall chemically. Other metal halides in the arc tube dose, such as rare earth iodides, may produce arc tube damage in a similar manner. The net result is a loss of the metallic constituents, such as sodium, leading to degradation of the light output, and a buildup of free halide, such as iodine, that leads to arc instability and eventual arc extinction.

There is substantial literature on the loss of sodium in high-pressure metal halide lamps. Early work is reviewed by John F. Waymouth in his book on Electric Discharge Lamps (MIT Press, 1971, pp 266–277). E. Fischer contributed a paper on "Formation of Free Iodine in Metal Halide Lamps" to the 1988 Symposium in High Temperature Lamp Chemistry. The sodium loss is attributed to diffusion of sodium through the arc tube wall as well as to reactions within the arc tube.

A method of using a protective metal halide film in high-pressure, electrodeless discharge lamps is described in U.S. Pat. No. 5,032,757, issued Jul. 16, 1991, to Witting. In that patent, the portion of the arc tube wall which is nearest the plasma arc discharge is maintained at a lower temperature than the remainder of the arc tube, so that a condensate of metal halide forms a protective layer thereon. The Witting patent discloses an electrodeless high intensity discharge lamp having an excitation coil disposed about an arc tube which includes thermal apparatus for ensuring that a metal halide condensate forms a protective film on the portion of the arc tube which is nearest the plasma arc discharge during lamp operation. For a short, cylindrical arc tube, the thermal apparatus comprises a heat shield situated on the top and/or bottom thereof. In one embodiment, the bottom of the arc tube is concave to ensure that the condensate does not collect on the bottom of the arc tube. The excitation coil may be situated sufficiently close to the arc tube to ensure that enough heat is removed from the side wall of the arc tube to a heal sink so that the protective metal halide film forms on the inner surface of the arc tube wall. An outer glass envelope is preferably situated between the arc tube and the excitation coil, which envelope also functions to remove heat from the arc tube side wall.

A practical problem has been observed in the use of a lamp having at least some of the above-described features. For example, on new arc tubes with smooth inside surfaces, the liquid dose forms droplets that are large enough to move downwards periodically to hotter portions of the arc tube under the force of gravity. From there the dose evaporates and re-condenses on cooler surfaces. This periodic movement tends to expose bare arc tube surfaces to degradation by the nearby arc. It is also accompanied by very undesirable changes in the position of the arc itself. In other words, the instability in the dose location causes arc instabilities that are not acceptable in a commercial light source. Thus, it would be desirable to provide such a lamp which overcomes the above and other disadvantages of the prior art.

SUMMARY OF THE INVENTION

The present invention relates to an electrodeless high intensity discharge lamp comprising, in combination, a light transmissive arc tube fabricated of quartz for containing a plasma arc discharge, the arc tube having a top and a bottom and a side wall in a generally spherical configuration with a dose or fill disposed within the arc tube. The fill includes at least one metal halide selected from the class of metal halides including sodium iodide and cerium iodide and a buffer gas selected from the class of buffer gasses including xenon and krypton. The amount of the metal halide is selected so that a reservoir of liquid metal halide condensate is present during operation of the lamp. An envelope is provided having a generally cylindrical central extent, a generally hemispherical lower extent encasing the arc tube and corresponding in shape to the curvature of the lower extent of the arc tube, and an upper extent with an upper end being generally circular in configuration with an aperture for a rod to extend therethrough. A rod is generally vertically disposed and extends upwardly through the aperture from the arc tube at a central extent thereof. Electrical power is applied to the lamp by an excitation coil that surrounds the lamp and is connected to a radio frequency power supply, with heat sinks coupled to the supply. The arc tube has an exterior surface and an interior surface with the interior surface including an annular region around the central extent of the side wall. The interior surface of the arc tube wall is smooth over the majority of its extent but with a stabilized surface in the annular region for enhanced securement of the liquid metal halide thereto. The stabilized surface is treated by a stabilizing treatment such as chemical etching by hydrochloric acid or by sand blasting or by the sintering of powdered metal materials including silicon oxide, aluminum oxide, cerium oxide, yttrium oxide and scandium oxide.

BRIEF DESCRIPTION OF THE DRAWINGS

The features and advantages of the present invention will become apparent from the following detailed description of the invention when read with the accompanying drawings in which.

DESCRIPTION OF THE PREFERRED EMBODIMENT

Figure 1:
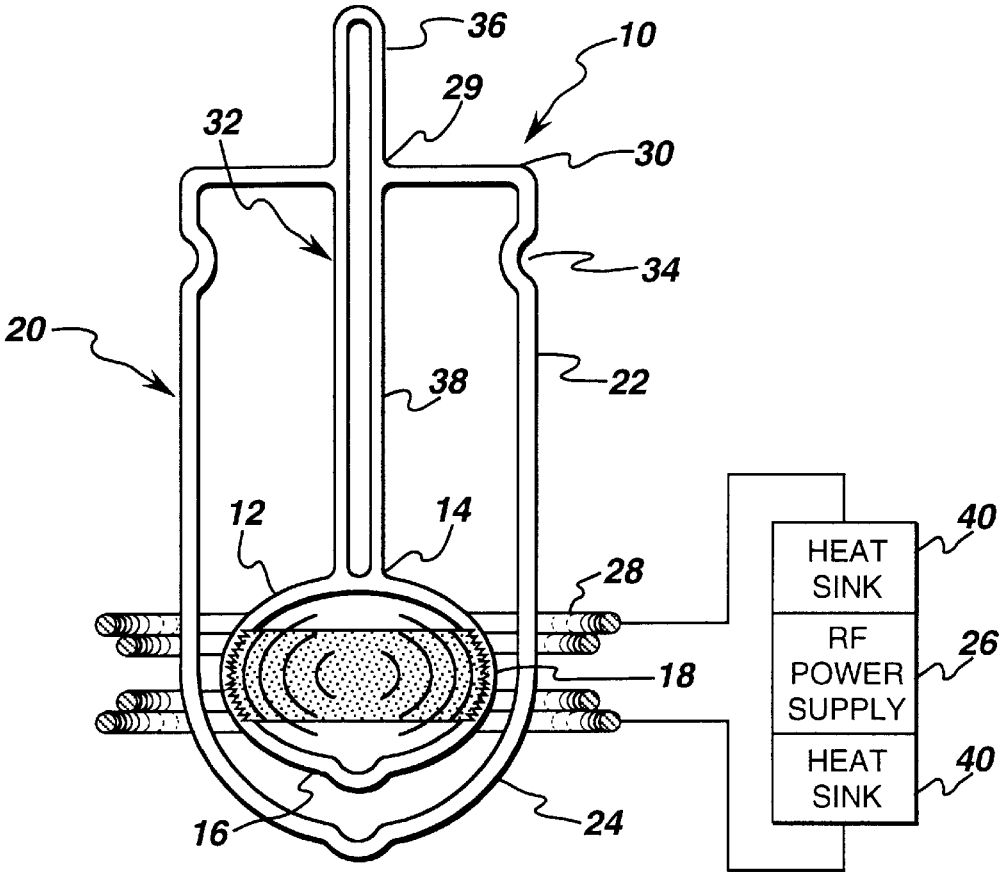
FIG. 1 is a partially cutaway side view of an electrodeless high intensity discharge (HID) lamp constructed in accordance with the primary embodiment of the present invention.

FIG. 1 illustrates an exemplary embodiment of an electrodeless high intensity discharge lamp 10 (HID). The central component of the lamp is a light transmissive arc tube 12. The arc tube is preferably fabricated of a high temperature glass, such as fused quartz, but may be made of other optically transparent ceramic materials such as polycrystalline alumina. In the preferred embodiment the shape is generally spherical, but it is larger around the equator than around its poles so as to appear somewhat compressed from top to bottom. Such shape promotes more nearly isothermal operation which decreases thermal losses and hence increases operating efficiency. As such the arc tube 12 has a top indicated at 14, a bottom indicated at 16 and an annular side wall indicated at 18.

A filling material, referred to as a "dose" or "fill", is contained within the arc tube 12 and sealed therein. The fill includes at least one metal halide, preferably selected from the class of metal halides including sodium iodide and cerium iodide. The fill also includes a buffer gas. The buffer gas is preferably selected from the class of buffer gasses including xenon and krypton. The amount of the metal halide is selected so that a reservoir of liquid metal halide condensate is present during operation and use of the lamp. The combined fill materials are utilized in weight proportions to generate visible radiation exhibiting high efficiency and good color rendering capabilities at white color temperatures.

The arc tube 12 is located within an envelope 20. The envelope is shaped to have a generally cylindrical central extent 22 and a hemispherical lower extent 24 enclosing the arc tube 12. The curvature of the lower extent 16 of the arc tube is generally symmetrical with the lower extent 24 of the envelope. A radio frequency (RF) power supply 26 applies electric current to an excitation coil 28, which generates an electric heating current within the arc tube 12. The envelope 20 also has an upper end 30 formed in a generally circular configuration to close the envelope. An aperture 29 is formed in the upper end 30 for the passage of a support rod 32 attached to the top 14 of the arc tube 12. In addition, an annular groove 34 is located in the side wall of the envelope adjacent to the upper end 30.

The support rod 32 has a hollow cylindrical configuration and an upper extent 36 extending through the aperture 29 in the upper end 30 of the envelope 20. The lower end 38 of the rod 32 is attached to the top of the arc tube 12 at a central extent thereof and functions to hold the arc tube in a proper orientation with respect to the envelope 20 for maximizing the efficiency during operation and use. The arc tube 12 and envelope 20 are desirably fabricated of the same material, preferably quartz.

Electrical power is applied to the lamp by the excitation coil 28 disposed about the arc tube 12 and connected to the radio frequency (RF) power supply 26. In operation, RF current in the coil 28 results in a changing magnetic field which produces within the arc tube an electric field which closes completely upon itself. Current flows through the fill within the arc tube as a result of this oscillating electric field, producing a toroidal arc discharge in the arc tube. Suitable operating frequencies for the RF power supply are in the range from 1 megahertz to 30 megahertz, an exemplary operating frequency being 13.56 megahertz.

For efficient lamp operation, the excitation coil 28 must not only have satisfactory coupling to the discharge plasma, but must also have low resistance and small size. A practical coil configuration avoids as much light blockage by the coil as practicable and hence maximizes light output. By way of example, the coil 28 is illustrated as having four turns which are arranged to have a substantially V-shaped cross section on each side of a coil center line. A similar coil configuration, having six turns, is also possible.

Typically, the excitation coil 28 of an HID lamp is coupled to a heat sink indicated at 40 for removing excess heat from the excitation coil during lamp operation in order to limit coil losses. That is, as the temperature of the excitation coil increases, coil resistance increases, thereby resulting in higher coil losses. A suitable heat sink 40 for cooling the excitation coil of an electrodeless HID lamp comprises a finned heat sink coupled in a conventional manner to RF power supply 20.

Figure 2:
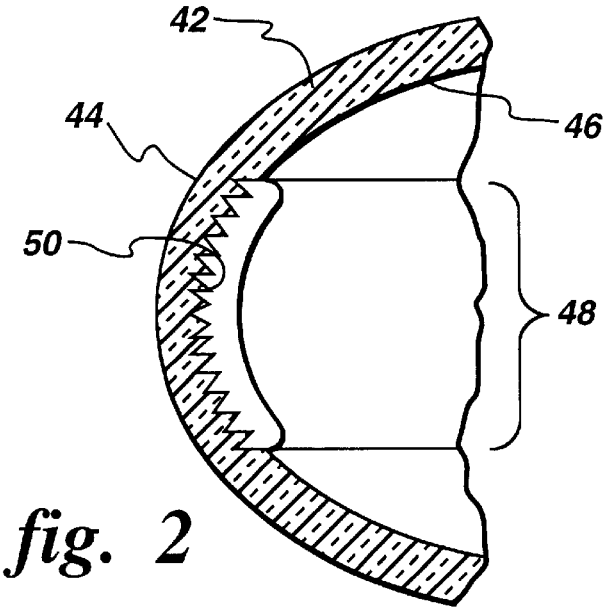
FIG. 2 is an enlarged cross-sectional view of a portion of the arc tube shown in FIG. 1.

In the embodiment of FIG. 2, the arc tube 12 is fabricated with an arc tube wall 42 defined by an exterior surface 44 and an interior surface 46. The interior surface includes an annular region 48 around the central extent of the tube wall. The interior surface 46 of the arc tube wall is generally smooth over the majority of its extent. In the annular region 48 around the central extent of the side wall, however, the interior surface is formed with a stabilized or roughened surface indicated at 50. Such stabilized surface is for enhanced securement of liquid metal halide which attaches itself thereto during normal operation and use of the lamp. This stabilized surface may be fabricated in any of a plurality of manners.

In the embodiment as shown in FIG. 2, the stabilized surface 50 is formed by either a chemical etching or by sand blasting. The chemical etching is preferably achieved through etching by an acid, preferably hydrochloric acid in the intended annular region. In the alternative, the stabilized surface may be created by the sintering of powdered metals onto the annular region 48. The powdered metal materials used for such sintering may be selected from the class of powdered metal materials including silicon oxide, aluminum oxide, cerium oxide, yttrium oxide and scandium oxide. Regardless of how the stabilized surface is effected, its presence on the interior surface of the arc tube adjacent the region of highest intensity, will effect the retention of liquid metal halide thereto for minimizing the damaging effects caused by operation and use of the lamp.

From the foregoing, it can be understood that it is a feature of this invention to stabilize the location of a film of liquid metal halides that protect those vulnerable regions of the arc tube of electrodeless, high-pressure gas discharge lamps which are in close proximity to the arc discharge. The stabilization is obtained by a mechanically roughened surface, or by deposition of a layer of metal oxide powder to form a roughened surface. The forces of adhesion between the roughened surface and the liquid, together with the cohesive forces within the liquid, will then overcome the gravitational force and keep the liquid fill in the desired location.

The basic structures of the present invention thus involve an arc tube 12 which is mounted within an outer, protective envelope 20 and dosed with a fill of metal halides and an inert gas. An electrical discharge is operated inside the arc tube by means of an external induction coil 28 that is connected to an RF power supply 26. Only a small portion of the metal halide fill is evaporated during lamp operation. Most of the fill remains as a liquid layer on the inside surface of the arc tube. As described in U.S. Pat. No. 5,032,757, this liquid layer is located around the periphery of the arc tube, close to the arc discharge, by maintaining that portion of the arc tube at a lower temperature than the remainder of the arc tube. The liquid layer is stabilized in this position by roughening the inner tube surface around the periphery to create a stabilizing surface.

As discussed above, the stabilization treatment of the peripheral portion of the arc tube, according to the present invention, can be implemented using any one or more of a plurality of methods. It may be general roughening of the surface or the application of a layer of metal oxide powder that may be sintered onto the surface by heat treatment.

The stabilizing treatment by means of surface roughening can be achieved by chemical etching of the arc tube surface as described above, or by the application of a high-velocity stream of small, hard particles, such as by sand blasting, also as described above. In either case, the uneven surface promotes wetting of the liquid on the arc tube surface, it impedes the flow of the liquid due to gravitational forces, and it increases the amount of fill per unit of surface area that will remain stable instead of forming droplets and moving downwards.

The stabilizing treatment by means of sintered powders can be obtained by a variety of well-known methods. For instance, the powders can be applied by electrostatic spraying. They can also be suspended in a suitable liquid that may include a binder to promote adhesion. The liquid can then be applied to the desired areas of the arc tube by spraying, or by suitably rotating the arc tube with a small pool of liquid inside. The liquid can then be evaporated and the binder can be burnt off. Finally, the powders can be more firmly attached to the tube wall by heating and sintering, if necessary. The final result is a surface that promotes wetting of the liquid film, that impedes liquid flow and that can hold large amounts of liquid fill due to capillary action.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. An electrodeless high intensity discharge lamp, comprising:

a light transmissive arc tube for containing a plasma arc discharge, the arc tube having a top, a bottom and a side wall with a fill disposed therein including at least one metal halide and a buffer gas, the amount of metal halide being selected such that a reservoir of liquid metal halide condensate is present during operation of the lamp, the lamp further comprising an excitation coil disposed about the arc tube for coupling to a radio frequency power supply for exciting the arc discharge in the fill, the arc tube having an interior surface with the interior surface including an annular region around the central extent of the side wall, the interior surface of the arc tube wall being smooth over the majority of its extent and having a roughened surface in the annular region to create a stabilized area for impeding surface flow of the liquid metal halide condensate.

2. The electrodeless high intensity discharge lamp as set forth in claim 1 wherein the roughened surface is created by sand blasting.

3. The electrodeless high intensity discharge lamp as set forth in claim 1 wherein the roughened surface is formed by acid etching.

4. The electrodeless high intensity discharge lamp as set forth in claim 1 wherein the annular region comprises a metal oxide powder sintered thereto to create the roughened surface.

5. The electrodeless high intensity discharge lamp as set forth in claim 4 wherein the metal oxide powder is selected from the class of metal oxide powders including silicon oxide, aluminum oxide, cerium oxide, yttrium oxide, and scandium oxide.

6. The electrodeless high intensity discharge lamp as set forth in claim 1 wherein the metal halide of the fill is selected from the class of metal halides including sodium iodide and cerium iodide.

7. The electrodeless high intensity discharge lamp as set forth in claim 1 wherein the buffer gas is selected from the class of buffer gasses including xenon and krypton.

8. The electrodeless high intensity discharge lamp as set forth in claim 1 and further comprising:

an envelope having a generally cylindrical central extent, the envelope having a generally hemispherical lower extent encasing the arc tube and corresponding in shape to the curvature of the lower extent of the arc tube, the envelope having an upper end with a generally circular configuration and including an aperture for passage of an arc tube support rod therethrough.

9. The electrodeless high intensity discharge lamp as set forth in claim 8 and further comprising:

a rod generally vertically disposed and extending upwardly through the aperture from the arc tube at a central extent thereof.

10. The electrodeless high intensity discharge lamp as set forth in claim 9 and further comprising:

excitation wires with a radio frequency energy source operatively coupled with respect to the cell and with heat sink fins coupled to the source.

* * * * *